US010190578B2

(12) United States Patent
Chang

(10) Patent No.: US 10,190,578 B2
(45) Date of Patent: Jan. 29, 2019

(54) MINIATURE PUMP

(71) Applicant: Koge Micro Tech Co., Ltd, New Taipei (TW)

(72) Inventor: Kun-Lin Chang, New Taipei (TW)

(73) Assignee: KOGE MICRO TECH CO., LTD, New Taipei (TW)

( * ) Notice: Subject to any disclaimer, the term of this patent is extended or adjusted under 35 U.S.C. 154(b) by 561 days.

(21) Appl. No.: 14/672,247

(22) Filed: Mar. 30, 2015

(65) Prior Publication Data

US 2016/0237997 A1 Aug. 18, 2016

(30) Foreign Application Priority Data

Feb. 13, 2015 (CN) ..... 2015 1 0080891
Feb. 13, 2015 (CN) ..... 2015 2 0107515 U
Feb. 13, 2015 (CN) ..... 2015 2 0107520 U

(51) Int. Cl.
*F04B 35/04* (2006.01)
*F04B 43/02* (2006.01)

(52) U.S. Cl.
CPC ..... *F04B 35/04* (2013.01); *F04B 43/021* (2013.01); *F04B 43/026* (2013.01)

(58) Field of Classification Search
CPC ..... F04B 35/04; F04B 43/021; F04B 43/026; F04B 43/00; F04B 43/02; F04B 43/04; F04B 43/025
See application file for complete search history.

(56) References Cited

U.S. PATENT DOCUMENTS 5,632,607 A * 5/1997 Popescu ..... F04B 43/026 137/512.4
6,048,183 A * 4/2000 Meza ..... F04B 43/026 417/569
6,382,928 B1 * 5/2002 Chang ..... F04B 43/026 417/269

FOREIGN PATENT DOCUMENTS

CN 202690357 U 1/2013

* cited by examiner

*Primary Examiner* — Philip E Stimpert
(74) *Attorney, Agent, or Firm* — CKC & Partners Co., Ltd.

(57) ABSTRACT

A miniature pump includes a cylinder, a piston module, a driving module and a wall body. The cylinder has a first end and a second end opposite to each other along a direction. The piston module is accommodated in the cylinder. The piston module has at least one pumping chamber structure protruded towards the second end, and the pumping chamber structure is able to extend or retract along the direction. The driving module is located at the second end and connected to the pumping chamber structure, configured to drive the pumping chamber structure to extend or retract along the direction. The wall body at least partially surrounds a position of the pumping chamber structure near the first end, and is located between the cylinder and the pumping chamber structure.

12 Claims, 6 Drawing Sheets

MINIATURE PUMP

RELATED APPLICATIONS

This application claims priority to Chinese Application Serial Number 201510080891.0, filed Feb. 13, 2015, Chinese Application Serial Number 201520107515.1, filed Feb. 13, 2015, Chinese Application Serial Number 201520107520.2, filed Feb. 13, 2015, which are herein incorporated by reference.

BACKGROUND

Technical Field

The present disclosure relates to miniature pumps.

Description of Related Art

A miniature pump is a pump of a tiny size. Due to its tiny size, the motor typically used is of a relatively low efficiency. Therefore, the quality of the design of the valve units and the compression units of a miniature pump has a key effect on the efficiency of the miniature pump.

In tradition, a miniature pump has a piston module and a cylinder, and the piston module is located inside the cylinder. During operation, the pumping chamber of the piston module is driven to extend or retract. However, since it is easy for the piston module to deviate relative to the cylinder, when the miniature pump operates, it is easy for the outer wall of the piston module to rub against the inner wall of the cylinder, causing the damage of the outer wall of the piston module, and thus the malfunction of the miniature pump.

As a result, how to prevent the outer wall of the piston module from rubbing against the inner wall of the cylinder is an important direction for the development of miniature pumps.

SUMMARY

A technical aspect of the present disclosure provides a miniature pump, which can isolate the outer wall of the pumping chamber structure and the inner wall of the cylinder, such that the pumping chamber structure is prevented from getting rubbed and damaged.

According to an embodiment of the present disclosure, a miniature pump includes a cylinder, a piston module, a driving module and a wall body. The cylinder has a first end and a second end opposite to each other along a direction. The piston module is accommodated in the cylinder. The piston module has at least one pumping chamber structure protruded towards the second end, and the pumping chamber structure is able to extend or retract along the direction. The driving module is located at the second end and connected to the pumping chamber structure, configured to drive the pumping chamber structure to extend or retract along the direction. The wall body at least partially surrounds a position of the pumping chamber structure near the first end, and is located between the cylinder and the pumping chamber structure.

In one or more embodiments of the present disclosure, the wall body and the pumping chamber structure are integrally molded.

In one or more embodiments of the present disclosure, the cylinder has a cylinder plate and the piston module includes a plate portion, a piston portion and a connecting portion. The plate portion is stacked on a side of the cylinder plate facing the first end, and the pumping chamber structure is located on a side of the plate portion facing the second end. The piston portion is connected to a side of the pumping chamber structure away from the plate portion. The connecting portion is connected to a side of the piston portion away from the pumping chamber structure. The driving module is connected to the connection portion and drives the pumping chamber structure to extend or retract along the direction.

In one or more embodiments of the present disclosure, the cylinder plate has at least one air intake hole.

In one or more embodiments of the present disclosure, the plate portion includes a plate main body and at least one air intake valve piece. The air intake valve piece is connected to the plate main body, and the air intake valve piece covers the air intake hole.

In one or more embodiments of the present disclosure, the plate portion further includes a plurality of installation components. Adjacent installation components form a first recessed portion in between. Each of the installation components includes a first installation portion and a second installation portion, in which the first installation portion and the second installation portion are disposed at intervals on an outer periphery of the plate portion.

In one or more embodiments of the present disclosure, the first installation portion is disposed with an air intake valve piece, and the second installation portion extends outwards from a top surface of the pumping chamber structure. The first installation portion and the second installation portion form a second recessed portion in between.

In one or more embodiments of the present disclosure, the cylinder includes at least one supporting portion. The supporting portion is disposed on the cylinder plate, and a shape of the supporting portion matches with the installation components.

According to another embodiment of the present disclosure, a miniature pump includes a cylinder and a piston module. The cylinder has a first end and a second end opposite to each other along a direction. The cylinder has a cylinder plate and the cylinder plate has at least one air intake hole. The piston module is accommodated in the cylinder. The piston module includes a plate portion. The plate portion is stacked on a side of the cylinder plate facing the first end. The plate portion has a plate main body and at least one air intake valve piece. The air intake valve piece covers and seals the air intake hole. The air intake valve piece has a root and an edge. The root is connected to the plate main body. The air intake valve piece tilts towards the first end about the root. The edge is composed of two straight-line sections, two curved sections and a circular section. The two straight-line sections are respectively connected to the two opposite ends of the root, the two curved sections are respectively connected to the straight-line sections, and the circular section is connected to the curved sections.

In one or more embodiments of the present disclosure, the piston module further has at least one pumping chamber structure. The pumping chamber structure is located on a side of the plate portion facing the second end and protruded towards the second end. The pumping chamber structure is able to extend or retract along the direction.

In one or more embodiments of the present disclosure, the root of the air intake valve piece is near to the pumping chamber structure relative to the edge.

In one or more embodiments of the present disclosure, the miniature pump further includes a driving module. The driving module is located at the second end and connected to the pumping chamber structure, being configured to drive the pumping chamber structure to extend or retract along the direction.

In one or more embodiments of the present disclosure, the piston module includes a piston portion and a connecting portion. The piston portion is connected to a side of the pumping chamber structure away from the plate portion. The connecting portion is connected to a side of the piston portion away from the pumping chamber structure. The driving module is connected to the connection portion and drives the pumping chamber structure to extend or retract along the direction.

According to another embodiment of the present disclosure, a miniature pump includes a cylinder, a piston module and a driving module. The cylinder has a first end and a second end opposite to each other along a direction. The cylinder has a cylinder plate. The piston module is accommodated in the cylinder. The piston module includes a plate portion, at least one pumping chamber structure and a sealing portion. The plate portion is stacked on a side of the cylinder plate facing the first end. The plate portion has a plate main body and at least one air intake valve piece connected to the plate main body. The pumping chamber structure is located on a side of the plate portion facing the second end. The pumping chamber structure has a pumping chamber. The sealing portion surrounds as a loop and is disposed on a side of the plate portion facing the first end. The pumping chamber and the air intake valve piece are located within the inner edge of the sealing portion. The driving module is located at the second end and connected to the pumping chamber structure, being configured to drive the pumping chamber structure to extend or retract along the direction.

In one or more embodiments of the present disclosure, the piston module includes a piston portion and a connecting portion. The piston portion is connected to a side of the pumping chamber structure away from the plate portion. The connecting portion is connected to a side of the piston portion away from the pumping chamber structure. The driving module is connected to the connection portion and drives the pumping chamber structure to extend or retract along the direction.

In one or more embodiments of the present disclosure, the cylinder plate further includes at least one air intake hole. The air intake valve piece covers and seals the air intake hole.

In one or more embodiments of the present disclosure, the miniature pump further includes a compression plate. The compression plate is stacked on the side of the plate portion facing the first end. The compression plate has a plurality of exhaust openings with positions correspondent to the pumping chamber.

In one or more embodiments of the present disclosure, the miniature pump further includes an exhaust valve piece. The exhaust valve piece is connected to a side of the compression plate facing the first end, with position correspondent to the exhaust openings.

When compared with the prior art, the above-mentioned embodiments of the present disclosure have at least the following advantages:

(1) Since the wall body at least partially surrounds a position of the pumping chamber structure near the first end, and is located between the cylinder and the pumping chamber structure, the relative position of the piston module and the cylinder can be fixed. This means the deviation of the piston module relative to the cylinder can be avoided. Furthermore, the outer wall of the pumping chamber structure and the inner wall of the cylinder is isolated, hence, when the pumping chamber structure extends or retracts along the direction, the outer wall of the pumping chamber structure and the inner wall of the cylinder will not rub against each other, and the chance that the pumping chamber structure gets damaged is avoided.

(2) Since the wall body at least partially surrounds a position of the pumping chamber structure near the first end, and is located between the cylinder and the pumping chamber structure, such that the relative position of the piston module and the cylinder is fixed, and the deviation of the piston module relative to the cylinder is avoided, the air intake valve piece will not deviate relative to the air intake hole. Hence, the effect that the air intake valve piece 126 covers and seals the air intake hole is also unaffected.

(3) Since only the straight-line sections and the curved sections exist between the circular section and the root, the bending moment about the root produced by the air intake valve piece can be effectively reduced. Thus, the deformation and the tilting up of the air intake valve piece due to a too large force are avoided. Consequently, the air intake valve piece can effectively cover and seal the air intake hole.

(4) Since no sealing portion exists between the pumping chamber and the air intake valve piece, when the piston module is assembled between the compression plate and the cylinder, the compression plate will not exert excessive pressure against the local position of the plate portion between the pumping chamber and the air intake valve piece. Thus, the local position of the plate portion between the pumping chamber and the air intake valve piece will not be deformed, and the air intake valve piece will not be tilted up due to deformation. As a result, the sealing criteria of the miniature pump can be maintained.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
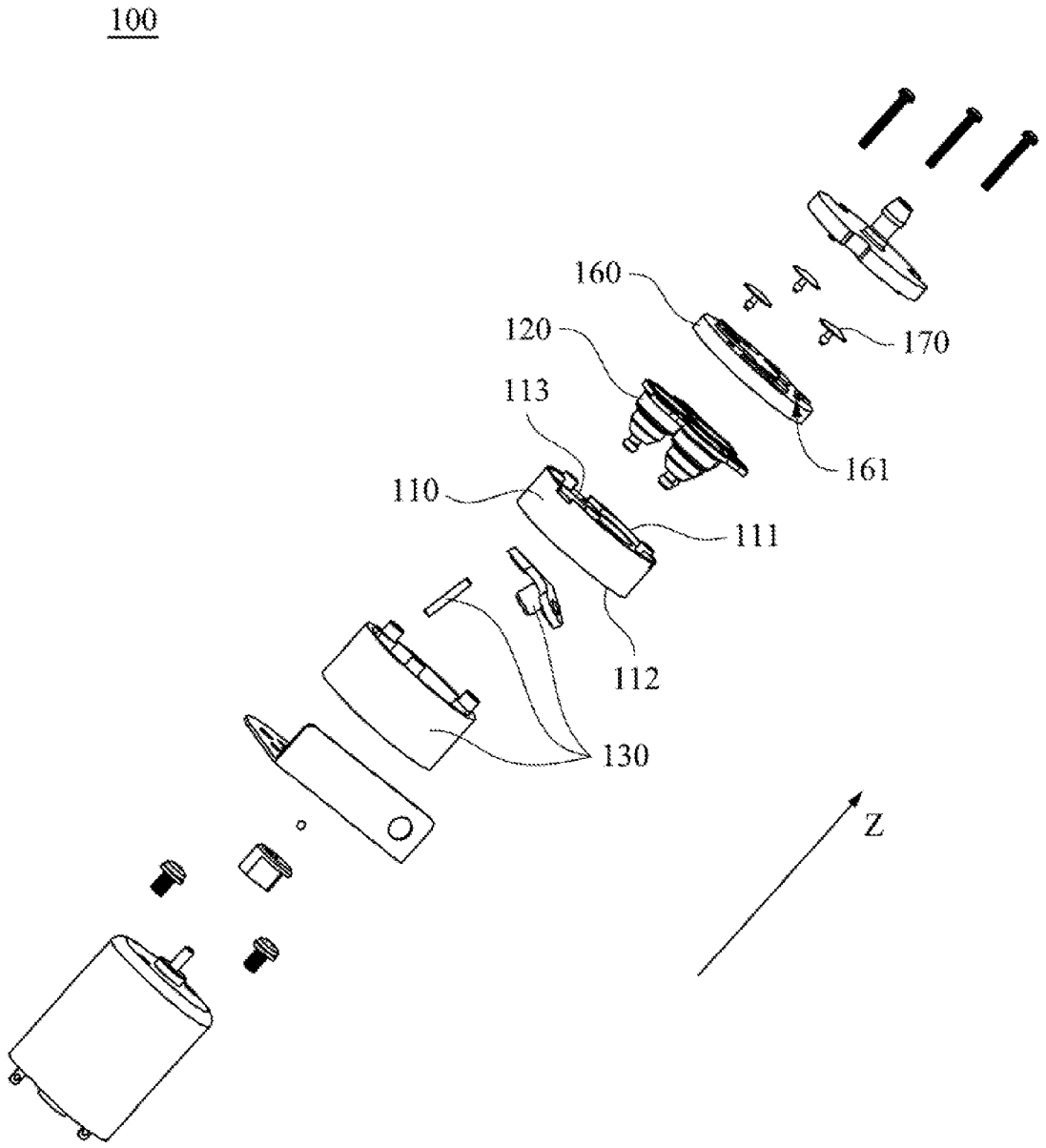
FIG. 1 is an exploded perspective view of a miniature pump according to an embodiment of the present disclosure.

Drawings will be used below to disclose a plurality of embodiments of the present disclosure. For the sake of clear illustration, many practical details will be explained together in the description below. However, it is appreciated that the practical details should not be used to limit the claimed scope. In other words, in some embodiments of the present disclosure, the practical details are not essential. Moreover, for the sake of drawing simplification, some customary structures and elements in the drawings will be schematically shown in a simplified way. Wherever possible, the same reference numbers are used in the drawings and the description to refer to the same or like parts.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 2:
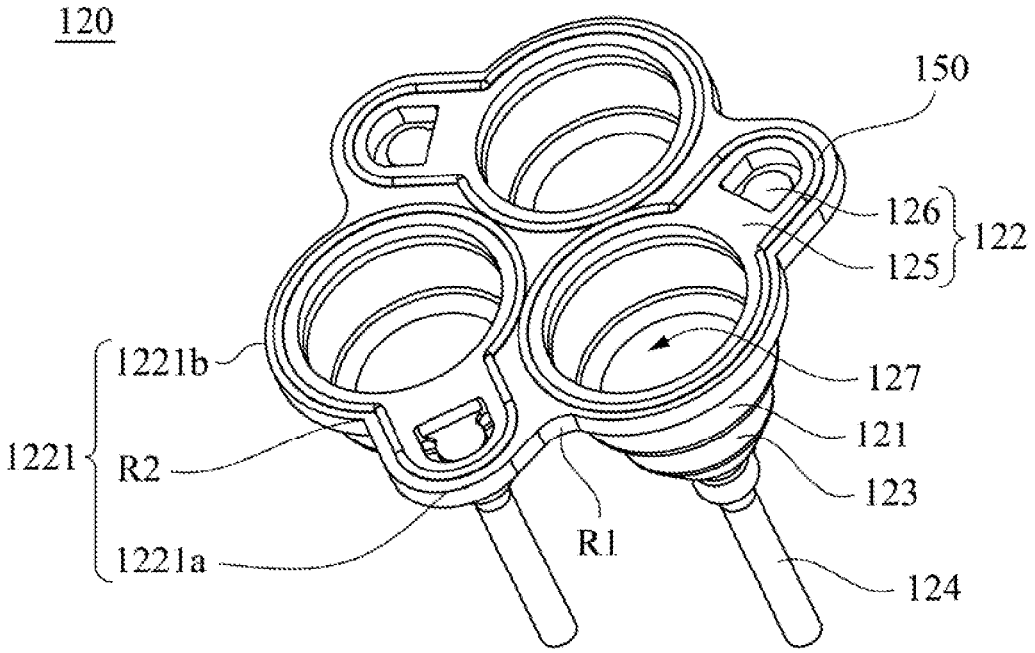
FIG. 2 is a schematic perspective view of the piston module of FIG. 1.
Figure 3:
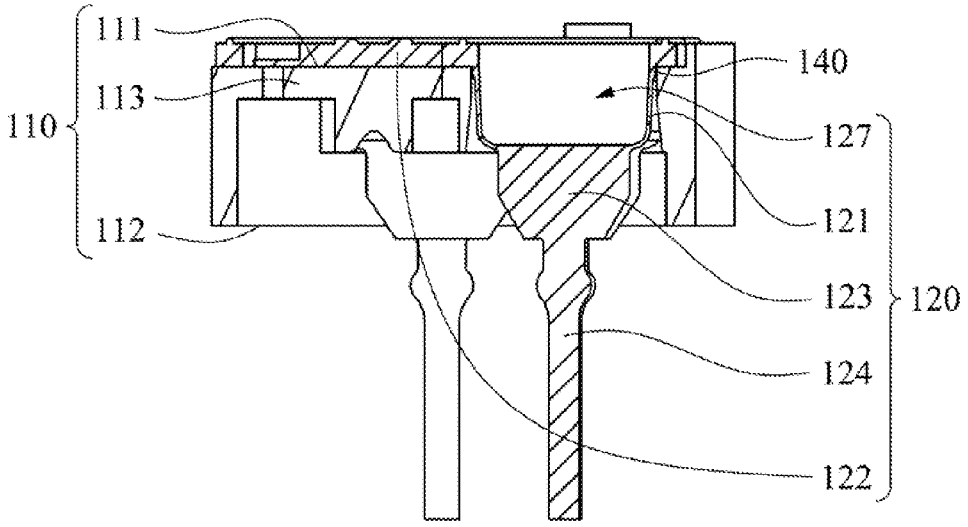
FIG. 3 is a sectional view of the assembly of the piston module and the cylinder of FIG. 1.
Figure 4:
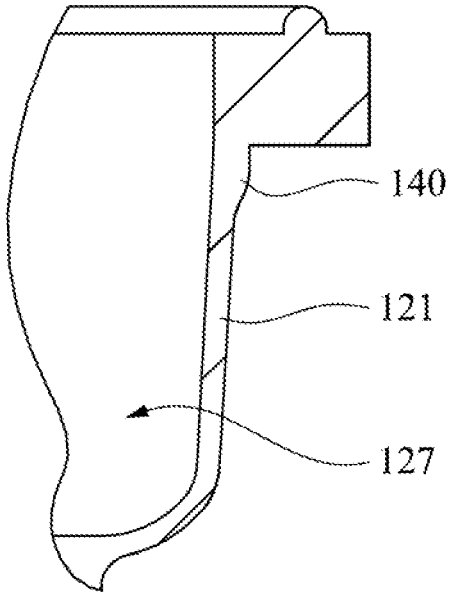
FIG. 4 is a partially enlarged view of the piston module of FIG. 3.

Please refer to FIGS. 1-4. FIG. 1 is an exploded perspective view of a miniature pump 100 according to an embodiment of the present disclosure. FIG. 2 is a schematic perspective view of the piston module 120 of FIG. 1. FIG. 3 is a sectional view of the assembly of the piston module 120 and the cylinder 110 of FIG. 1. FIG. 4 is a partially enlarged view of the piston module 120 of FIG. 3.

As shown in FIGS. 1-4, a miniature pump 100 includes a cylinder 110, a piston module 120, a driving module 130 and a wall body 140. The cylinder 110 has a first end 111 and a second end 112 opposite to each other along a direction Z. The piston module 120 is accommodated in the cylinder 110. The piston module 120 has at least one pumping chamber structure 121. The pumping chamber structure 121 protrudes towards the second end 112, and the pumping chamber structure 121 is able to extend or retract along the direction Z. The driving module 130 is located at the second end 112 and connected to the pumping chamber structure 121, configured to drive the pumping chamber structure 121 to extend or retract along the direction Z. The wall body 140 at least partially surrounds a position of the pumping chamber structure 121 near the first end 111, and is located between the cylinder 110 and the pumping chamber structure 121.

In other words, since the wall body 140 at least partially surrounds a position of the pumping chamber structure 121 near the first end 111, and is located between the cylinder 110 and the pumping chamber structure 121, the relative position of the piston module 120 and the cylinder 110 can be fixed. This means the deviation of the piston module 120 relative to the cylinder 110 can be avoided. Furthermore, the outer wall of the pumping chamber structure 121 and the inner wall of the cylinder 110 is isolated, hence, when the pumping chamber structure 121 extends or retracts along the direction Z, the outer wall of the pumping chamber structure 121 and the inner wall of the cylinder 110 will not rub against each other, and the chance that the pumping chamber structure 121 gets damaged is avoided.

In this embodiment, the wall body 140 and the pumping chamber structure 121 are integrally molded. However, this does not intend to limit the present disclosure.

To be more specific, the cylinder 110 has a cylinder plate 113 and the piston module 120 includes a plate portion 122, a piston portion 123 and a connecting portion 124. The plate portion 122 is stacked on a side of the cylinder plate 113 facing the first end 111, and the pumping chamber structure 121 is located on a side of the plate portion 122 facing the second end 112. The piston portion 123 is connected to a side of the pumping chamber structure 121 away from the plate portion 122. The connecting portion 124 is connected to a side of the piston portion 123 away from the pumping chamber structure 121. The driving module 130 is connected to the connection portion 124 and drives the pumping chamber structure 121 to extend or retract along the direction Z.

Furthermore, assuming the width of the wall body 140 to be d, the inner diameter of the pumping chamber structure 121 be D, and the wall thickness of the pumping chamber structure 121 be T, in practical applications, the inner diameter of the cylinder 110 should be equal to or slightly larger than $D+T\times2+d\times2$. To be clear, the wall thickness T of the pumping chamber structure 121 should not be too thick, so as to avoid the rubbing of the outer wall of the pumping chamber structure 121 against the outer wall of the piston portion 123 during the extension or retraction of the pumping chamber structure 121 along the direction Z. Thus, the chance that the pumping chamber structure 121 gets damaged is also avoided.

As shown in FIG. 2, the plate portion 122 further includes a plurality of installation components 1221. Adjacent installation components 1221 form a first recessed portion R1 in between. Each of the installation components 1221 includes a first installation portion 1221*a* and a second installation portion 1221*b*, in which the first installation portion 1221*a* and the second installation portion 1221*b* are disposed at intervals on an outer periphery of the plate portion 122.

Moreover, the first installation portion 1221*a* is disposed with an air intake valve piece 126, and the second installation portion 1221*b* extends outwards from a top surface of the pumping chamber structure 121. The first installation portion 1221*a* and the second installation portion 1221*b* form a second recessed portion R2 in between.

Figure 5:
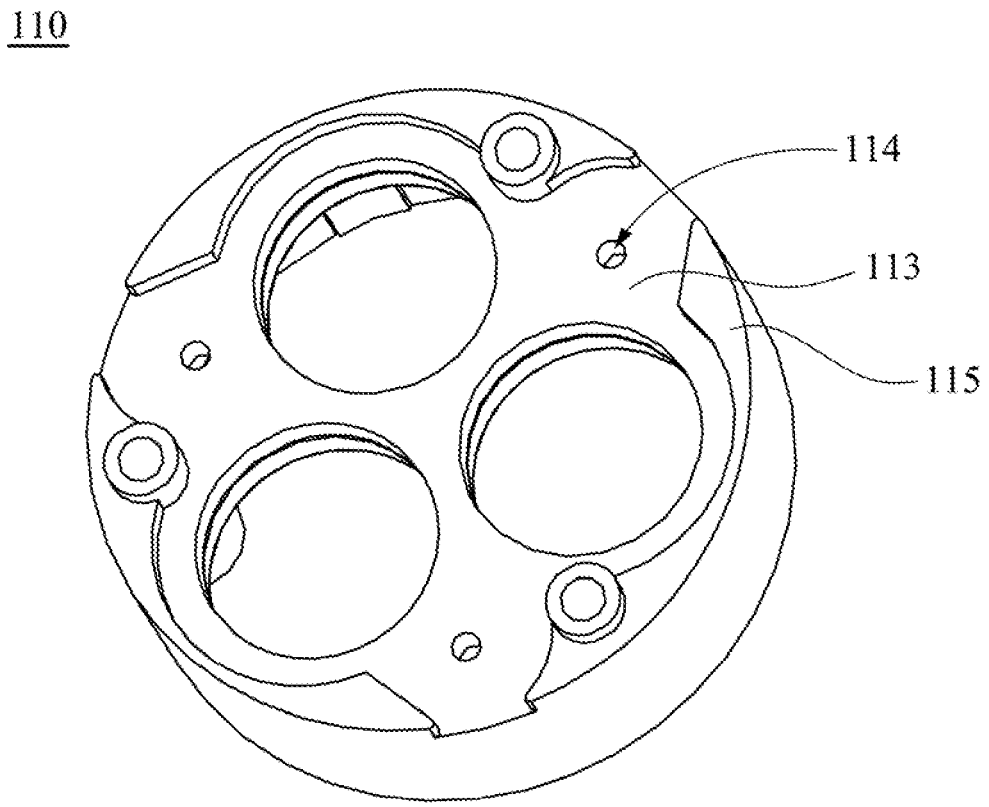
FIG. 5 is a schematic perspective view of the cylinder of FIG. 1.

Please refer to FIG. 5. FIG. 5 is a schematic perspective view of the cylinder 110 of FIG. 1. As shown in FIG. 5, the cylinder 110 includes at least one supporting portion 115. The supporting portion 115 is disposed on the cylinder plate 113, and a shape of the supporting portion 115 matches with the installation components 1221. As a result, when the miniature pump 100 operates, the piston module 120 will not rotate relative to the cylinder 110, and the relative position of the piston module 120 and the cylinder 110 can be fixed.

In addition, the cylinder plate 113 has at least one air intake hole 114. Please go back to FIG. 2. As shown in FIG. 2, the plate portion 122 of the piston module 120 includes a plate main body 125 and at least one air intake valve piece 126. The air intake valve piece 126 is connected to the plate main body 125. Correspondingly, the air intake valve piece 126 covers and seals the air intake hole 114. As mentioned above, since the wall body 140 at least partially surrounds a position of the pumping chamber structure 121 near the first end 111, and is located between the cylinder 110 and the pumping chamber structure 121, such that the relative position of the piston module 120 and the cylinder 110 is fixed, and the deviation of the piston module 120 relative to the cylinder 110 is avoided, the air intake valve piece 126 will not deviate relative to the air intake hole 114. Hence, the effect that the air intake valve piece 126 covers and seals the air intake hole 114 is also unaffected.

Please stay in FIG. 2. As shown in FIG. 2, the pumping chamber structure 121 includes a pumping chamber 127, and the miniature pump further comprises a sealing portion 150. The sealing portion 150 surrounds as a loop and is disposed on a side of the plate portion 122 facing the first end 111. The pumping chamber 127 and the air intake valve piece 126 are located within the inner edge of the sealing portion 150. Furthermore, as shown in FIG. 2, the sealing portion 150 is not disposed on the plate portion 122 between the pumping chamber 127 and the air intake valve piece 126.

Please go back to FIG. 1. As shown in FIG. 1, the miniature pump 100 further includes a compression plate 160. The compression plate 160 is stacked on the side of the plate portion 122 facing the first end 111. The compression plate 160 has a plurality of exhaust openings 161 with positions correspondent to the pumping chamber 127. As mentioned above, since no sealing portion 150 exists between the pumping chamber 127 and the air intake valve piece 126, when the piston module 120 is assembled between the compression plate 160 and the cylinder 110, the compression plate 160 will not exert excessive pressure against the local position of the plate portion 122 between the pumping chamber 127 and the air intake valve piece 126. Thus, the local position of the plate portion 122 between the pumping chamber 127 and the air intake valve piece 126 will not be deformed, and the air intake valve piece 126 will not be tilted up due to deformation. As a result, the sealing criteria of the miniature pump 100 can be maintained.

As shown in FIG. 1, the miniature pump 100 further includes at least one exhaust valve piece 170. The exhaust valve piece 170 is connected to a side of the compression plate 160 facing the first end 111, with position correspondent to the exhaust openings 161.

Figure 6:
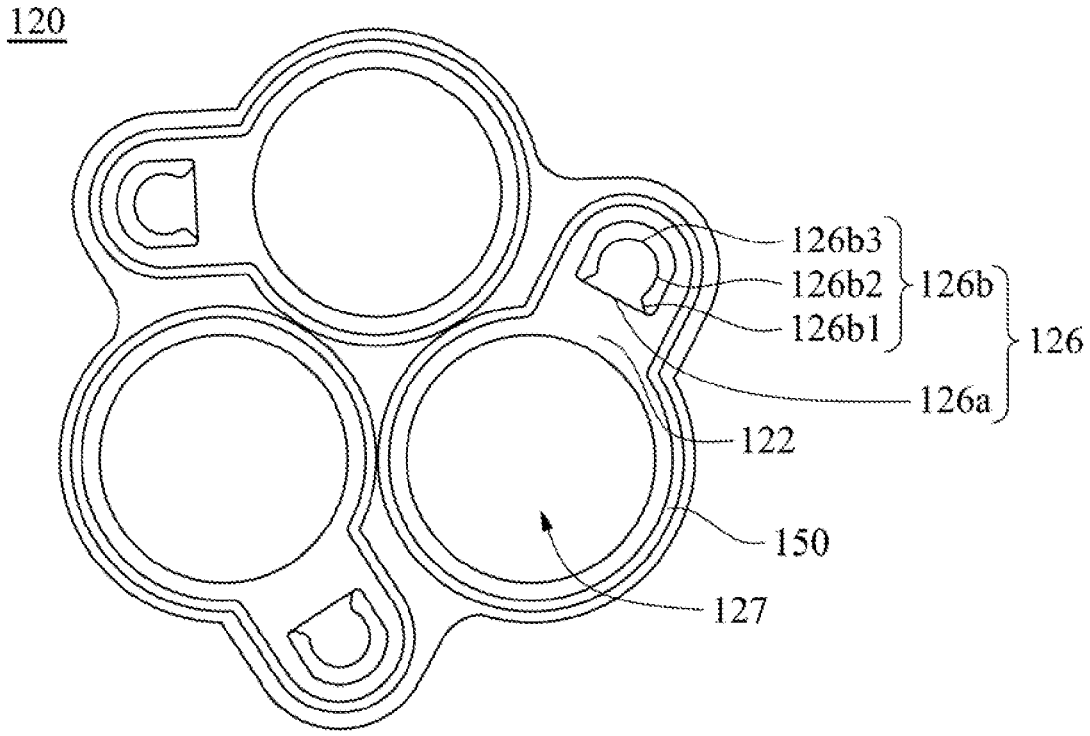
FIG. 6 is a plan view of the piston module of FIG. 2.

Please refer to FIG. 6. FIG. 6 is a plan view of the piston module 120 of FIG. 2. As shown in FIG. 6, the air intake valve piece 126 has a root 126*a* and an edge 126*b*. The root 126*a* is connected to the plate main body 125. The air intake valve piece 126 can tilt towards the first end 111 about the root 126*a*. The edge 126*b* is composed of two straight-line sections 126*b*1, two curved sections 126*b*2 and a circular section 126*b*3. The two straight-line sections 126*b*1 are respectively connected to the two opposite ends of the root 126*a*. The two curved sections 126*b*2 are respectively connected to the straight-line sections 126*b*1. The circular section 126*b*3 is connected to the curved sections 126*b*2.

In other words, only the straight-line sections 126*b*1 and the curved sections 126*b*2 exist between the circular section 126*b*3 and the root 126*a*. As a result, the bending moment about the root 126*a* produced by the air intake valve piece 126 can be effectively reduced. Thus, the deformation and the tilting up of the air intake valve piece 126 due to a too large force is avoided. Consequently, the air intake valve piece 126 can effectively cover and seal the air intake hole 114.

Furthermore, as shown in FIG. 6, the root 126*a* of the air intake valve piece 126 is near to the pumping chamber structure 121 relative to the edge 126*b*.

In summary, when compared with the prior art, the embodiments of the present disclosure mentioned above have at least the following advantages:

(1) Since the wall body at least partially surrounds a position of the pumping chamber structure near the first end, and is located between the cylinder and the pumping chamber structure, the relative position of the piston module and the cylinder can be fixed. This means the deviation of the piston module relative to the cylinder can be avoided. Furthermore, the outer wall of the pumping chamber structure and the inner wall of the cylinder is isolated, hence, when the pumping chamber structure extends or retracts along the direction, the outer wall of the pumping chamber structure and the inner wall of the cylinder will not rub against each other, and the chance that the pumping chamber structure gets damaged is avoided.

(2) Since the wall body at least partially surrounds a position of the pumping chamber structure near the first end, and is located between the cylinder and the pumping chamber structure, such that the relative position of the piston module and the cylinder is fixed, and the deviation of the piston module relative to the cylinder is avoided, the air intake valve piece will not deviate relative to the air intake hole. Hence, the effect that the air intake valve piece 126 covers and seals the air intake hole is also unaffected.

(3) Since only the straight-line sections and the curved sections exist between the circular section and the root, the bending moment about the root produced by the air intake valve piece can be effectively reduced. Thus, the deformation and the tilting up of the air intake valve piece due to a too large force are avoided. Consequently, the air intake valve piece can effectively cover and seal the air intake hole.

(4) Since no sealing portion exists between the pumping chamber and the air intake valve piece, when the piston module is assembled between the compression plate and the cylinder, the compression plate will not exert excessive pressure against the local position of the plate portion between the pumping chamber and the air intake valve piece. Thus, the local position of the plate portion between the pumping chamber and the air intake valve piece will not be deformed, and the air intake valve piece will not be tilted up due to deformation. As a result, the sealing criteria of the miniature pump can be maintained.

Although the present disclosure has been described in considerable detail with reference to certain embodiments thereof, other embodiments are possible. Therefore, the spirit and scope of the appended claims should not be limited to the description of the embodiments contained herein.

It will be apparent to the person having ordinary skill in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A miniature pump, comprising:

a cylinder having a first end and a second end opposite to each other along a first direction, the cylinder further having a cylinder plate;

a piston module accommodated in the cylinder, the piston module comprising:

a plate portion stacked on a side of the cylinder plate, the side of the cylinder plate facing the first end, the plate potion further comprising a plurality of installation components, adjacent installation components having a first recessed portion formed therebetween on an outer periphery of the plate portion, each of the installation components comprising a first installation portion and a second installation portion, wherein the first installation portion and the second installation portion are disposed at intervals on the outer periphery of the plate portion;

a pumping chamber structure located on a side of the plate portion facing the second end and protruded towards the second end;

a piston portion connected to a side of the pumping chamber structure facing away from the plate portion; and a connecting portion connected to a side of the piston portion facing away from the pumping chamber structure;

a driving module located at the second end, the driving module having a wobble plate and a driving rod connected to the wobble plate, and the connection portion being connected to the wobble plate, and the driving module being configured to drive the pumping chamber structure to extend or retract along the first direction; and a ledge projecting outwardly from an outer surface of the pumping chamber structure along a second direction perpendicular to the first direction, so as to contact an inner surface of the cylinder, wherein the cylinder comprises:

a plurality of circular holes, wherein a portion of the pumping chamber structure of the piston module is respectively positioned in each hole; and a plurality of supporting portions that extend in the first direction toward the piston module from an upper surface of the cylinder plate forming said side of the cylinder plate, each of the supporting portions extending circumferentially along an outer periphery of the cylinder plate adjacent to a corresponding one of the holes for a distance that exceeds a diameter of the corresponding hole to extend past the corresponding hole on both sides of the corresponding hole, the supporting portions being separated from each other, each of the supporting portions extending also inwardly from the outer periphery of the cylinder plate to surround a part of the corresponding hole while maintaining a distance from the corresponding hole, wherein said side of the cylinder plate is monolithically formed with the upper surface of the cylinder;

wherein a shape of each of the supporting portions is complementary to a shape of the plate portion of the piston module which is stacked on said side of the cylinder to thereby fix a relative position of the piston module and the cylinder.

2. The miniature pump of claim 1, wherein the ledge and the pumping chamber structure are integrally molded.

3. The miniature pump of claim 1, wherein the cylinder plate has at least one air intake hole.

4. The miniature pump of claim 3, wherein the plate portion of the piston module comprises a plate main body and at least one air intake valve piece, the air intake valve piece is connected to the plate main body, and the air intake valve piece covers the air intake hole.

5. The miniature pump of claim 1, wherein each first installation portion is disposed with an air intake valve piece, and each corresponding second installation portion extends outwards from a top surface of the pumping chamber structure, wherein the first installation portion and the second installation portion form a second recessed portion in between on the outer periphery of the plate portion.

6. A miniature pump, comprising:

a cylinder having a first end and a second end opposite to each other along a first direction, the cylinder having a cylinder plate and the cylinder plate having at least one air intake hole;

a piston module accommodated in the cylinder, the piston module comprising:

a plate portion stacked on a side of the cylinder plate, the side of the cylinder plate facing the first end, the plate portion further comprising a plurality of installation components, adjacent installation components having a first recessed portion formed therebetween on an outer periphery of the plate portion, each of the installation components comprising a first installation portion and the second installation portion, wherein the first installation portion and the second installation portion are disposed at intervals on the outer periphery of the plate portion, the plate portion having a plate main body and at least one air intake valve piece, the air intake valve piece covering and sealing the air intake hole, and the air intake valve piece having:

a root connected to the plate main body, the air intake valve piece tilting towards the first end about the root; and an edge composed of two straight-line sections, two curved sections and a circular section, wherein the two straight-line sections are respectively connected to the two opposite ends of the root, the two curved sections are respectively connected to the straight-line sections, and the circular section is connected to the curved sections;

a pumping chamber structure located on a side of the plate portion facing the second end and protruded towards the second end;

a piston portion connected to a side of the pumping chamber structure away from the plate portion; and facing a connecting portion connected to a side of the piston portion facing away from the pumping chamber structure; and a ledge projecting outwardly from an outer surface of the pumping chamber structure along a second direction perpendicular to the first direction, so as to contact an inner surface of the cylinder, wherein the cylinder comprises:

a plurality of circular holes, wherein a portion of the pumping chamber structure of the piston module is positioned in the holes; and a plurality of supporting portions that extend in the first direction toward the piston module from an upper surface of the cylinder plate forming said side of the cylinder plate, each of the supporting portions extending circumferentially along an outer periphery of the cylinder plate adjacent to a corresponding one of the holes for a distance that exceeds a diameter of the corresponding hole to extend past the corresponding hole on both sides of the corresponding hole, the supporting portions being separated from each other, each of the supporting portions extending also inwardly from the outer periphery of the cylinder plate to surround a part of the corresponding hole while maintaining a distance from the corresponding hole, wherein said side of the cylinder plate is monolithically formed with the upper surface of the cylinder;

wherein a shape of each of the supporting portions is complementary to a shape of the plate portion of the piston module which is stacked on said side of the cylinder to thereby fix a relative position of the piston module and the cylinder.

7. The miniature pump of claim 6, wherein the root of the air intake valve piece is between the pumping chamber structure and the edge.

8. The miniature pump of claim 6, further comprising:

a driving module located at the second end, the driving module having a wobble plate and a driving rod connected to the wobble plate, and the connection portion being connected to the wobble plate, and the driving module being configured to drive the pumping chamber structure to extend or retract along the direction.

9. A miniature pump, comprising:

a cylinder having a first end and a second end opposite to each other along a first direction, the cylinder having a cylinder plate;

a piston module accommodated in the cylinder, the piston module comprising:

a plate portion stacked on a side of the cylinder plate facing the first end, the plate portion further comprising a plurality of installation components, adjacent installation components having a first recessed portion formed therebetween on an outer periphery of the plate portion, each of the installation components comprising a first installation portion and a second installation portion, wherein the first installation portion and the second installation portion are disposed at intervals on the outer periphery of the plate portion, the plate portion having a plate main body and at least one air intake valve piece connected to the plate main body;

a pumping chamber structure located on a side of the plate portion facing the second end, the pumping chamber structure having a pumping chamber;

a piston portion connected to a side of the pumping chamber structure facing away from the plate portion;

a connecting portion connected to a side of the piston portion facing away from the pumping chamber structure; and a sealing portion in an at least partially annular shape and being disposed on a side of the plate portion facing the first end, the pumping chamber and the air intake valve piece being located within an inner edge of the sealing portion;

a ledge projecting outwardly from an outer surface of the pumping chamber structure along a second direction perpendicular to the first direction, so as to contact an inner surface of the cylinder; and a driving module located at the second end, the driving module having a wobble plate and a driving rod connected to the wobble plate, the connection portion being connected to the wobble plate, and the driving module being configured to drive the pumping chamber structure to extend or retract along the first direction, wherein the cylinder comprises:

a plurality of circular holes, wherein a portion of the pumping chamber structure of the piston module is positioned in each hole; and a plurality of supporting portions that extend in the first direction toward the piston module from an upper surface of the cylinder plate forming said side of the cylinder plate, each of the supporting portions extending circumferentially along an outer periphery of the cylinder plate adjacent to a corresponding one of the holes for a distance that exceeds a diameter of the corresponding hole to extend past the corresponding hole on both sides of the corresponding hole the supporting portions being separated from each other, each of the supporting portions extending also inwardly from the outer periphery of the cylinder plate to surround a part of the corresponding hole while maintaining a distance from the corresponding hole, wherein said side of the cylinder plate is monolithically formed with the upper surface of the cylinder;

wherein a shape each of the supporting portions is complementary to a shape of the plate portion of the piston module which is stacked on said side of the cylinder to thereby fix a relative position of the piston module and the cylinder.

10. The miniature pump of claim 9, wherein the cylinder plate further comprises at least one air intake hole, and the air intake valve piece covers and seals the air intake hole.

11. The miniature pump of claim 9, further comprising:

a compression plate stacked on the side of the plate portion facing the first end, the compression plate having a plurality of exhaust openings with positions corresponding to the pumping chamber.

12. The miniature pump of claim 11, further comprising:

an exhaust valve piece connected to a side of the compression plate facing the first end, with position correspondent to the exhaust openings.

* * * * *